US008910797B2

(12) United States Patent
Gillespie

(10) Patent No.: US 8,910,797 B2
(45) Date of Patent: Dec. 16, 2014

(54) METHOD AND APPARATUS FOR SEPARATING PLASTICS FROM COMPOST AND OTHER RECYCLABLE MATERIALS

(71) Applicant: Garret Gillespie, Whitehorse (CA)

(72) Inventor: Garret Gillespie, Whitehorse (CA)

(73) Assignee: Boreal Compost Enterprises Ltd., Whitehorse (CA)

( * ) Notice: Subject to any disclaimer, the term of this patent is extended or adjusted under 35 U.S.C. 154(b) by 89 days.

(21) Appl. No.: 13/830,014

(22) Filed: Mar. 14, 2013

(65) Prior Publication Data

US 2014/0262969 A1 Sep. 18, 2014

(51) Int. Cl.
*B03B 4/00* (2006.01)
*B07B 9/02* (2006.01)

(52) U.S. Cl.
CPC . *B07B 9/02* (2013.01); *Y10S 209/93* (2013.01)
USPC ..... 209/477; 209/479; 209/490; 209/493; 209/506; 209/930

(58) Field of Classification Search
CPC ..... B03B 4/00; B03B 4/02; B03B 4/06; B03B 4/065
USPC ..... 209/477, 479, 490, 493, 495, 496, 504, 209/506, 930, 932
See application file for complete search history.

(56) References Cited

U.S. PATENT DOCUMENTS

| | | | | | |
|---|---|---|---|---|---|
| 2,028,904 | A * | 1/1936 | Haworth | 209/467 |
| 3,108,950 | A * | 10/1963 | Buckley | 209/466 |
| 4,105,124 | A * | 8/1978 | Skinner | 209/693 |
| 4,642,180 | A * | 2/1987 | Kaufman | 209/44 |
| 5,588,534 | A * | 12/1996 | Harel | 209/3.1 |
| D377,182 | S * | 1/1997 | Simpson | D15/147 |
| 5,875,898 | A * | 3/1999 | Fry | 209/28 |
| 7,438,188 | B2 * | 10/2008 | Stolworthy | 209/44 |
| 7,708,145 | B2 * | 5/2010 | Li et al. | 209/471 |
| 2014/0102955 | A1 * | 4/2014 | Viny | 209/644 |

* cited by examiner

*Primary Examiner* — Joseph C Rodriguez
(74) *Attorney, Agent, or Firm* — Miller Thomson LLP; Tai W Nahm

(57) ABSTRACT

There is disclosed a method and apparatus for separating plastics from compost material. In an embodiment, the method comprises: providing an inclined trough having a feed entry at a top end and a materials discharge end at a bottom end, the inclined trough including a plurality of riffles positioned substantially perpendicularly to a direction of flow of compost material down the inclined trough; inducing a vibration in the inclined trough to induce a prolonged period of hindered unsettling in the compost material; providing a longitudinal dam to at least one side of the inclined trough; and generating an air flow over a substantial length of the inclined trough perpendicular to the direction of flow of compost material down the inclined trough, thereby to blow plastics separated from the compost material over the longitudinal dam.

20 Claims, 4 Drawing Sheets

METHOD AND APPARATUS FOR SEPARATING PLASTICS FROM COMPOST AND OTHER RECYCLABLE MATERIALS

FIELD OF THE INVENTION

The present disclosure relates generally to a method and apparatus for separating plastics from compost and other recyclable materials, such as paper, wood waste, and municipal solid waste processing.

BACKGROUND OF THE INVENTION

With increasing awareness of potential damage to the environment resulting from recyclables directed to waste landfill dumps or incineration, more industries and municipalities are implementing waste diversion and recycling programs to significantly reduce the volume of waste that must be processed in a conventional manner. However, as the rate of waste diversion and recycling has increased, processing facilities have found that certain recyclables, in particular biodegradable organic materials, have increasingly become contaminated with non-biodegradable materials due to improper separation, or materials used to package the biodegradable compost. In particular, contamination by various types of plastics is a very common problem.

Municipal and industrial compost facilities in North America and in other jurisdictions are struggling with a growing plastics contamination problem as they attempt to recycle biodegradable compost materials in an efficient and cost effective manner. A particular challenge is that there are numerous types of plastics found in compost which are diverse in shape, size and density, ranging from larger pieces of solid plastics, to thin strips of plastics torn from plastic bags and packaging. Furthermore, biodegradable organic materials often have high moisture content, making effective separation of plastics from the organic materials technically challenging. These technical challenges may result in increased wear on processing machinery, increased labour and operating costs, and a reduction in the market value of the finished compost product. At worst, the processed compost may be so contaminated by that it is unusable altogether and must ultimately be discarded as waste.

Various prior art solutions have attempted to address the problem of plastics separation with some degree of effectiveness, but existing solutions are unable to remove plastics contaminants to a sufficient level without very close monitoring of operating conditions, and possibly additional processing steps to prepare the contaminated compost material for separation.

Therefore, what is needed is an improved method and apparatus for separating plastics contaminants from compost which overcomes at least some of the limitations in the prior art.

SUMMARY OF THE INVENTION

The present disclosure relates generally to a method and apparatus for separating plastics contaminants from compost materials. The method and apparatus can effectively remove plastics contaminants of all shapes and sizes from compost (e.g. organic materials, yard waste, and woodchips) under a wide range of compost moisture content conditions. The method and apparatus may also be used to remove plastic contaminants from recycled paper and other recycled materials where specific gravities are similar to plastic.

In an aspect, there is provided an apparatus for separating plastics from compost material, comprising: an inclined trough having a feed entry at a top end and a materials discharge end at a bottom end, the inclined trough including a plurality of riffles positioned substantially perpendicularly to a direction of flow of compost material down the inclined trough; one or more vibratory motors configured to induce a vibration in the inclined trough; a longitudinal dam provided to at least one side of the inclined trough; and one or more blowers or vacuums configured to generate an air flow over a substantial length of the inclined trough perpendicular to the direction of flow of compost material down the inclined trough.

In another aspect, there is provided a method for separating plastics from compost material, comprising: providing an inclined trough having a feed entry at a top end and a materials discharge end at a bottom end, the inclined trough including a plurality of riffles positioned substantially perpendicularly to a direction of flow of compost material down the inclined trough; inducing a vibration in the inclined trough to induce a prolonged period of hindered unsettling in the compost material; providing a longitudinal dam to at least one side of the inclined trough; and generating an air flow over a substantial length of the inclined trough perpendicular to the direction of flow of compost material down the inclined trough, thereby to blow plastics separated from the compost material over the longitudinal dam.

Other features and advantages of the present invention will become apparent from the following detailed description and accompanying drawings. It should be understood, however, that the detailed description and specific examples are given by way of illustration and not limitation. Many modifications and changes within the scope of the present invention may be made without departing from the spirit thereof, and the invention includes all such modifications.

Figure 1:
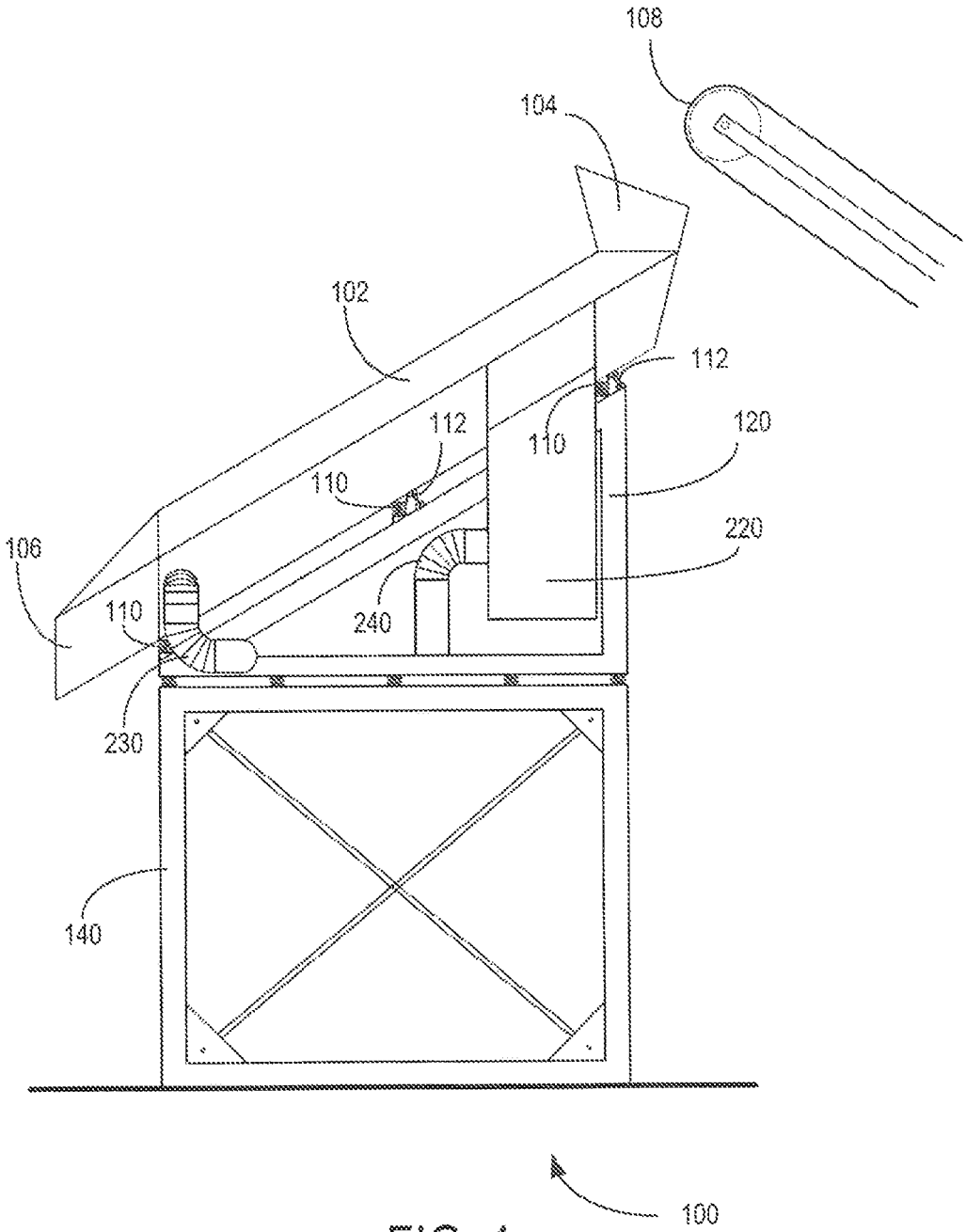
FIG. 1 shows an illustrative example of an apparatus in accordance with an illustrative embodiment.

In the drawings, embodiments of the invention are illustrated by way of example. It is to be expressly understood that the description and drawings are only for the purpose of illustration and as an aid to understanding, and are not intended as a definition of the limits of the invention.

DETAILED DESCRIPTION

As noted above, the present disclosure relates generally to a method and apparatus for separating plastics contaminants from compost materials. The method and apparatus can effectively remove plastics contaminants of all shapes and sizes from compost and woodchips under a wide range of compost moisture content conditions.

Figure 2:
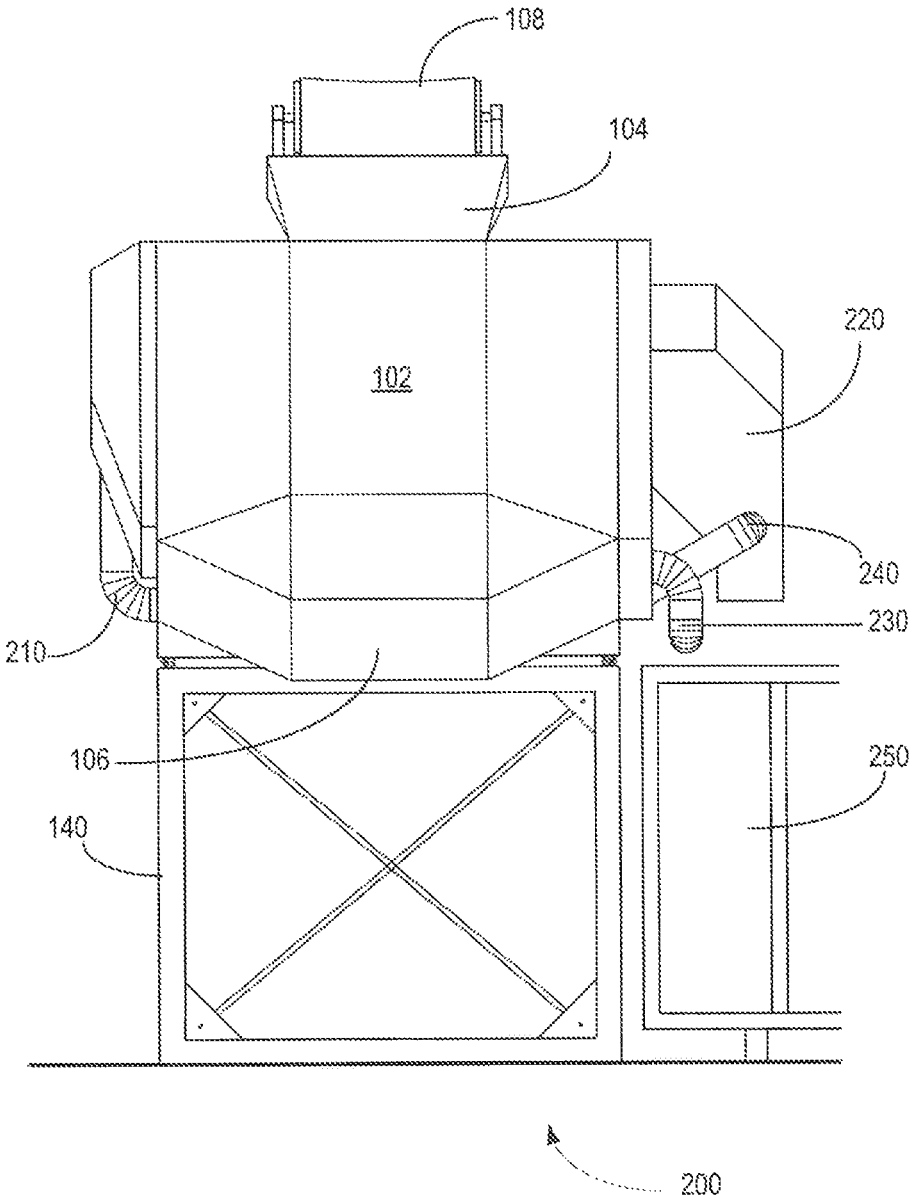
FIG. 2 shows a front view of the apparatus of FIG. 1.

By way of example, and not by way of limitation, FIG. 1 shows an illustrative apparatus in accordance with an embodiment. As shown in FIG. 1 and FIG. 2, apparatus 100 includes an inclined trough 102 having a feed entry 104 at a top end to receive unprocessed compost from a conveyor 108, and a materials discharge end 106 at a bottom end to discharge processed compost. Trough 102 is normally covered such that trough 102 is substantially enclosed above and below.

Still referring to FIG. 1 and FIG. 2, trough 102 is preferably mounted on a plurality of flexibly resilient supports 110. The flexibly resilient supports 110 may be steel springs, for example, but they may also be any other type of flexibly resilient supports suitable for supporting trough 102 and materials flowing down trough 102 under normal operating conditions. Movable joints 112 may be positioned adjacent the flexibly resilient supports 110 to keep trough 102 spaced apart but movable relative to an underlying inclined supporting frame 120. The inclined supporting frame 120 may itself be mounted on a base 140 to sufficiently raise the materials discharge end 106 to a suitable height and to allow a collection bin or conveyor (not shown) to be positioned below the materials discharge end 106 of trough 102 to collect and/or convey the processed compost.

As best shown from a front view in FIG. 2, trough 102 further includes an air inflow duct 210 on one side which blows air into trough 102, and one or more discharge chutes on the other side, in this example including a course plastics discharge 220 and a fine plastics discharge 230. The course plastics discharge 220 and a fine plastics discharge 230 may discharge plastics separated from the compost into a roll-off bin 250, as shown in FIG. 2 from a front view. In an embodiment, fine plastics discharge 230 may be assisted by a vacuum for suctioning separated fine plastics particles as explained in more detail further below. Coarse plastics and fine plastics may be collected separately in different bins in roll-off bin 250.

Figure 3:
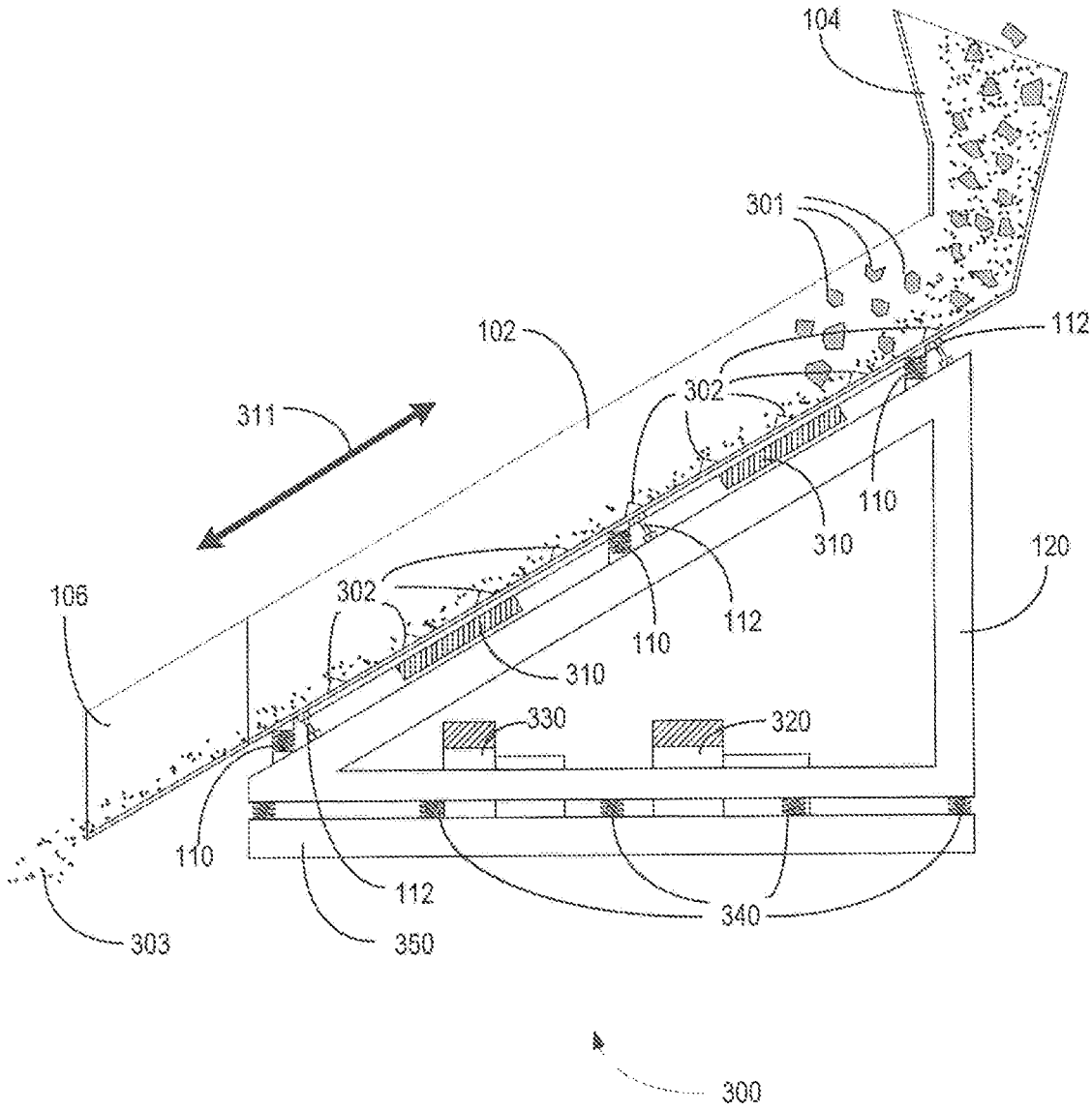
FIG. 3 shows a detailed side view of an internal portion of the trough in the apparatus of FIG. 1.

The operation of apparatus 100 will now be explained in more detail with reference to FIG. 3 and FIG. 4. As shown in FIG. 3, inclined trough 102 is represented in a detailed cross-sectional side view to better illustrate the flow of unprocessed compost material contaminated by plastics 301 that enters trough 102 via feed entry 104 shown at the left side of FIG. 4.

As compost material flows down the length of inclined trough 102, the compost material encounters a plurality of riffles 302 positioned substantially perpendicularly to the flow of compost material down the incline.

By way of example, and not by way of limitation, trough 102 may be positioned at an incline of approximately 20° from horizontal.

In a preferred embodiment, the incline of trough 102 is approximately 20° from horizontal. This incline has been found through experimentation to provide a good flow of compost material through trough 102, while simultaneously allowing the compost material to attain a hindered settling condition behind each riffle 302 on the trough 102. While 20° from horizontal has been found to provide good performance, trough 102 may operate anywhere between about 30° from horizontal and 10° from horizontal.

Still referring to FIG. 3, one or more vibrators 310 are attached to trough 102 in order to induce a vibrating motion in trough 102. By way of example, vibrators 310 may comprise electromechanical vibrators which induce a reciprocating vibratory motion 311 substantially parallel to the direction of flow of compost materials down inclined trough 102. This reciprocating motion is facilitated by the plurality of flexibly resilient supports 110 and movable joints 112 which allow movement of trough 102 in relation to inclined supporting frame 120.

Still referring to FIG. 3, one or more vacuums 320 and/or blowers 330 provide an airflow within inclined trough 102 as trough 102 undergoes a vibratory motion induced by one or more vibrators 310.

In a preferred embodiment, the vibratory motion induced by the vibrators 310 is a reciprocating vibratory motion that is symmetrical and linear. This vibratory motion allows the compost material to remain substantially in constant contact with the surface of the trough 102, thus increasing the effects of hindered settling along the length of trough 102 as the compost material travels down the slope of the trough 102.

In a preferred embodiment, the vibratory motion has a frequency in the range from about 600 cycles per minute to about 1200 cycles per minute, at an amplitude range of about 1/16th inch to about 1/4 inch. However, vibratory motions outside of this range are also possible.

Still referring to FIG. 3, in order to minimize wear resulting from the vibratory motion of trough 102, inclined supporting frame 120 may itself be mounted on isolation modules 340, such as steel springs or any other suitable resiliently flexible components, to isolate inclined supporting frame 120 from an isolated base 350.

Figure 4:
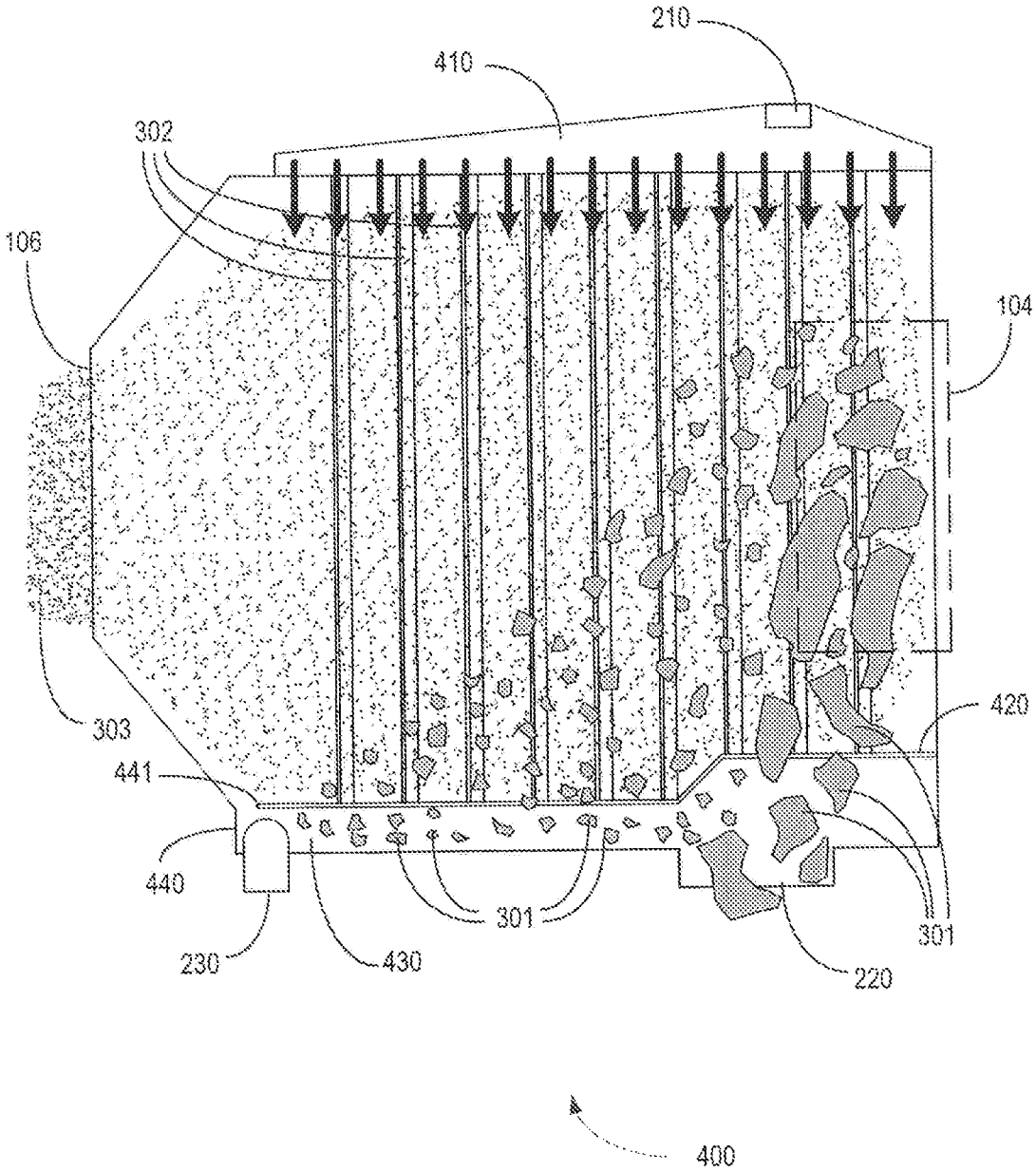
FIG. 4 shows a detailed top view of the internal portion of the trough in apparatus of FIG. 1.

Now referring to FIG. 4, shown is a detailed top view of inclined trough 102 in which plastics 301 contaminated compost material is received at feed intake 104. As noted above, compost material flowing down the length of inclined trough 102 encounters a plurality of riffles 302 that are positioned substantially perpendicularly to the direction of flow of the compost material down inclined trough 102. Riffles 302 are of a sufficient height and sufficient angle such that while they provide an obstacle to unhindered flow of compost material down inclined trough 102, they do not stop the flow entirely. The dimensions of the riffles 302 including height, profile, and angles may be selected based on the type of compost materials being processed.

In an embodiment, the height of the riffles 302, as measured perpendicular to the trough 102, relates to the particle size and shape of the feed material being processed. The height of the riffles 302 is also related to the design depth or thickness of the bed of feed material as it flows down the trough 102. If the feed material consists mostly of large particles, the feed material may flow over a low riffle without attaining a satisfactory state of hindered settling, thereby reducing separating efficiency.

Adjusting the height of the riffles 302 according to the median particle size is therefore important. In a preferred embodiment, the bed depth, which is the thickness of the material perpendicular to the trough surface as it flows down the incline, is no more than about 1 to 1.5 times the median particle diameter, with the riffle height being about 2 times the median particle diameter.

In a preferred embodiment, the cross section of the riffle 302 is such that each face that constitutes the riffle is inclined at between about 40° to 50° (e.g. 45°) from perpendicular to the trough. Experimentation has shown that other inclinations and riffle face shapes may not perform as well under wide ranging conditions.

In an embodiment, the number of riffles per unit length of the trough, in combination with the trough frequency and amplitude, determine the feed rate for a given separation efficiency. Experimentation has shown that there is a trade off between the feed rate and the separation efficiency, when contamination is held constant. Separation efficiency drops as feed rate increases. To maintain satisfactory feed rate at 90% to almost 100% separation, it is preferable to space the riffles no less than about 6 inches peak to peak, and no greater than about 12 inches peak to peak. Finer feed material demands the closer riffle spacing, coarser material requires wider spacing.

As flowing compost material meets each riffle 302, the compost material begins to boil or chum rapidly behind each riffle 302 before spilling over the peak of the riffle 302. In other words, riffles 302 hinder settling of the compost material on the surface of trough 102, and together with the vibrating motion of trough 102 induces a constant chum. As the compost material chums, the plastics contaminants rise to the surface of the churning compost material. It is believed that this separation occurs largely due to the differences in specific gravity between the plastics contaminants and the compost materials, and the moisture content absorbed by the compost materials which does not affect the plastics contaminants nearly as much.

Still referring to FIG. 4, as the compost material churns, and plastics are separated from the compost material by the riffles 302 and the vibratory motion of trough 102, air inflow duct 210 provides a flow of air over the surface of the churning compost material.

In an embodiment, airflow entering air inflow duct 210 is generated by one or more blowers 330. The inflow of air may be distributed over a substantial length of inclined trough 102 using for example an air manifold 410, which discharges the air across the trough 102 perpendicular to the flow of feed material. This air flow is generated by one or more blowers 330 as describe earlier, which may be located for example on the isolated base 350 of the trough 102, and connected to the air manifold 410 by means of flexible hose (not shown). Through experimentation, it has been found that an air flow speed in the range of about 300 feet per minute to 600 feet per minute provides good results. However, air flow speeds outside of this range are also possible, given the type of feed material and the type of plastics.

In an embodiment, in addition to one or more blowers 330, the apparatus may further include one or more vacuums 320 to collect finer plastics particles. The vacuum air may be positioned near the fine plastics separator, and travel through a flexible hose to vacuum 320.

The vacuum airflow and fine plastics passes through the vacuum 320 and is then discharged into a plastics chute. Vacuum air flow speeds in the range of about 3500 feet per minute to about 5000 feet per minute have been used with good results, but vacuum air flow speeds outside of this range are also possible.

In an embodiment, the transverse airflow over the churning compost material may be substantially even, or may be varied along the length of trough 102 in order to provide stronger airflow at one point along the trough 102 in comparison to another point along the trough 102. For example, a stronger flow of air may be provided closer to the feed intake 104 in order to force more coarse plastics contaminants to be blown across the trough 102 and to be discharged at coarse plastics discharge 220 on the other side. With the coarse plastics removed quickly by the stronger airflow, the fine plastic particles remain. These fine plastic particles are not caught by the air as easily as larger sizes and shapes, and their density is very similar to that of the compost. As the compost material flows down the trough 102, the air speed may be reduced so as to avoid removing fine compost along with the fine plastic pieces.

As the compost material also contains more moisture content as it enters the feed intake 104, the compost material is also weighed down more, such that a stronger air flow will not also discharge a substantial portion of the compost material. As the churning compost material flows further down the length of the trough 102, the compost material may lose some moisture content and become somewhat lighter. Therefore, a gentler air flow is preferred closer to the material discharge end 106 of trough 102. Processed compost material 303 separated from the plastics 301 exits materials discharge end 106.

In an embodiment, as shown in FIG. 4, a longitudinal dam 420 is positioned to one side along the length of trough 102 to prevent most of the compost material from flowing around the transverse riffles 302, and to provide a barrier between the compost material and plastics that have been separated from the compost material. The height of the longitudinal dam 420 may be substantially the same, or alternatively may be varied such that the height is gradually reduced towards the materials discharge end 106 of trough 102.

As the plastics contaminants chum to the surface of the churning compost material, air flow gently blows the plastics across the trough 102 towards the longitudinal dam 420. This longitudinal dam 420 allows the plastics to flow over it into the plastics concentrate channel 430. Once the separated plastics enters this channel 430 the plastics further separates into coarse particles and fine particles. The coarse plastics are mostly discharged to the coarse plastics discharge 220 closer to the feed intake 104, and the fine plastics flow further down the channel 430 to be discharged at a fine plastics discharge closer to the fines separator.

The coarse plastics are removed first because the large size and shape catches the airflow easily. The large pieces also tend to have a lower density than the compost, which further aids separation. The bulk of plastic contamination tends to be larger, coarser pieces, and these are usually removed from the trough within the first third of the separating area of the trough. Given that the coarse plastics catch the air flow relatively easily, they are blown out the plastics concentrate channel 430 into the coarse plastics discharge 220. Air speed may be adjusted to ensure the coarse plastics are discharged without also removing fine compost at the same time. Thus fine pieces of plastic remain in the plastics concentrate channel after the coarse plastics are removed. Fines plastic is contaminated with fines compost, with more fine materials being added to the concentrate channel, until the fines separator is reached.

A fine plastics separator 441 positioned closer to the material discharge end 106 removes the fines plastics from lighter compost material that remains in the trough 102. In an embodiment, the fine plastics separator 441 includes a dam 440 at a right angle to the flow of fine plastics concentrate. In an embodiment, a fine plastics vacuum nozzle 230 is placed directly above the fine plastics concentrate as it pools behind the dam 440. As the trough 102 constantly vibrates, the plastics float to the surface of any fine compost material that is mixed in with the plastics concentrate, and the fine plastics material is caught in the updraft of vacuum airflow. The fines plastics then enter the vacuum system and are collected. The remaining fine compost material vibrates around the dam 440, re-enters the flow of separated compost material at the bottom of the trough 102, and is discharged from material discharge end 106.

The cross sectional area of the vacuum nozzle is dependent on the width of the plastics concentrate channel 430. In a preferred embodiment, the nozzle 230 will cover approximately ⅔ of the width of the plastics concentrate channel 430, and be positioned centrally to the channel. The nozzle shall have a circular cross section, lowest point of the nozzle being situated 2" from the surface of the trough 102. Experimentation has shown that the nozzle will operate effectively within the range of 1" to 3" from the surface of the trough.

In an embodiment, there are two or more separating stations on the trough 102 for separating coarse and fine plastics. The largest one is for the coarse plastics, and may consist simply of a chute. The coarse plastics enter the chute (which is part of the trough and therefore vibrates) and are discharged from the chute by gravity, into a waiting container such as a common roil-off bin. The fines plastics are discharged into the same chute under positive air pressure, which also fall into the waiting container.

In experimentation, apparatus 100 has been found to effectively remove plastics of all shapes, sizes, compositions and densities from compost materials and woodchips. The plastics separation has been found to be effective under a wide range of compost moisture content levels, ranging from about 20% to 60% of water present, relative to the oven dry weight of the sample.

It has also been found that the apparatus of the present disclosure will effectively remove plastics of all kinds, shapes and sizes from tiny fragments of film, to plastic bottle tops, to large sheets of film, to shoe soles, and so on. Thus a key advantage is to be able to process a wide range of plastics types in one processing line. As the apparatus is capable of handling a wide range of feed material sizes, pre-processing of the feed materials into a more uniform size is not necessary.

Experimental testing has shown consistently high separation rates under wide ranging conditions of extremely high contamination (up to 10% plastics by volume). Results of separation have ranged from about 85%, and approaching almost complete separation and removal of plastics contaminants.

While the above example has described the separation of plastics from compost, it will be appreciated that the apparatus may be adapted for separating plastics from other types of materials that differ in moisture content and density from plastics. Examples may include separating plastics from wet paper, sand, and seaweed, for example.

Thus, in an aspect, there is provided an apparatus for separating plastics from compost material, comprising: an inclined trough having a feed entry at a top end and a materials discharge end at a bottom end, the inclined trough including a plurality of riffles positioned substantially perpendicularly to a direction of flow of compost material down the inclined trough; one or more vibratory motors configured to induce a vibration in the inclined trough; a longitudinal dam provided to at least one side of the inclined trough; and one or more blowers or vacuums configured to generate an air flow over a substantial length of the inclined trough perpendicular to the direction of flow of compost material down the inclined trough.

In an embodiment, the inclined trough is inclined between about 10° from horizontal to about 30° from horizontal.

In another embodiment, the inclined trough is mounted on a plurality of flexibly resilient supports.

In another embodiment, the one or more vibratory motors are configured to induce a reciprocating vibratory motion substantially parallel to the direction of flow of compost material down the inclined trough.

In another embodiment, the reciprocating vibratory motion has a frequency in the range from about 600 cycles per minute to about 1200 cycles per minute.

In another embodiment, the reciprocating vibratory motion has an amplitude range of about 1/16th inch to about 1/4 inch.

In another embodiment, the plurality of riffles are configured to be adapted to a median particle size of the compost material.

In another embodiment, the plurality of riffles have a height of about 2 times the median particle diameter.

In another embodiment, the riffles have a cross section such that each face of the riffle is inclined at about 40° to about 50° from perpendicular to the inclined trough.

In another embodiment, the riffles are spaced apart on the inclined trough at between about 6 inches peak to peak, to about 12 inches peak to peak based on the median particle size of the compost material.

In another aspect, there is provided a method for separating plastics from compost material, comprising: providing an inclined trough having a feed entry at a top end and a materials discharge end at a bottom end, the inclined trough including a plurality of riffles positioned substantially perpendicularly to a direction of flow of compost material down the inclined trough; inducing a vibration in the inclined trough to induce a prolonged period of hindered unsettling in the compost material; providing a longitudinal dam to at least one side of the inclined trough; and generating an air flow over a substantial length of the inclined trough perpendicular to the direction of flow of compost material down the inclined trough, thereby to blow plastics separated from the compost material over the longitudinal dam.

In an embodiment, the inclined trough is inclined between about 10° from horizontal to about 30° from horizontal.

In another embodiment, the method further comprises configuring the plurality of riffles to be adapted to a median particle size of the compost material.

In another embodiment, the method further comprises inducing a reciprocating vibratory motion substantially parallel to the direction of flow of compost material down the inclined trough.

In another embodiment, the reciprocating vibratory motion has a frequency in the range from about 600 cycles per minute to about 1200 cycles per minute.

In another embodiment, the reciprocating vibratory motion has an amplitude range of about 1/16th inch to about 1/4 inch.

In another embodiment, the method further comprises generating an air flow speed in a range from about 300 feet per minute to about 600 feet per minute.

In another embodiment, the method further comprises generating the air flow utilizing one or more blowers or vacuums.

In another embodiment, the method further comprises providing a coarse plastics discharge to discharge larger pieces of plastic separated from the compost material and blown over the longitudinal dam.

In another embodiment, the method further comprises providing a fine plastics discharge to discharge finer pieces of plastic blown over the longitudinal dam utilizing a vacuum.

While various embodiments and illustrative examples have been described above, it will be appreciated that these embodiments and illustrative examples are not limiting, and the scope of the invention is defined by the following claims.

The invention claimed is:

1. An apparatus for separating plastics from compost material, comprising:

an inclined trough having a feed entry at a top end and a materials discharge end at a bottom end, the inclined trough including a plurality of riffles positioned substantially perpendicularly to a direction of flow of compost material down the inclined trough;

one or more vibratory motors configured to induce a vibration in the inclined trough;

a longitudinal dam provided to at least one side of the inclined trough; and one or more blowers or vacuums configured to generate an air flow over a substantial length of the inclined trough perpendicular to the direction of flow of compost material down the inclined trough.

2. The apparatus of claim 1, wherein the inclined trough is inclined between about 10° from horizontal to about 30° from horizontal.

3. The apparatus of claim 2, wherein the inclined trough is mounted on a plurality of flexibly resilient supports.

4. The apparatus of claim 2, wherein the one or more vibratory motors are configured to induce a reciprocating vibratory motion substantially parallel to the direction of flow of compost material down the inclined trough.

5. The apparatus of claim 4, wherein the reciprocating vibratory motion has a frequency in the range from about 600 cycles per minute to about 1200 cycles per minute.

6. The apparatus of claim 5, wherein the reciprocating vibratory motion has an amplitude range of about $1/16^{th}$ inch to about ¼ inch.

7. The apparatus of claim 2, wherein the plurality of riffles are configured to be adapted to a median particle size of the compost material.

8. The apparatus of claim 7, wherein the plurality of riffles have a height of about 2 times the median particle diameter.

9. The apparatus of claim 8, wherein the riffles have a cross section such that each face of the riffle is inclined at about 40° to about 50° from perpendicular to the inclined trough.

10. The apparatus of claim 9, wherein the riffles are spaced apart on the inclined trough at between about 6 inches peak to peak, to about 12 inches peak to peak based on the median particle size of the compost material.

11. An method for separating plastics from compost material, comprising:

providing an inclined trough having a feed entry at a top end and a materials discharge end at a bottom end, the inclined trough including a plurality of riffles positioned substantially perpendicularly to a direction of flow of compost material down the inclined trough;

inducing a vibration in the inclined trough to induce a prolonged period of hindered unsettling in the compost material;

providing a longitudinal dam to at least one side of the inclined trough; and generating an air flow over a substantial length of the inclined trough perpendicular to the direction of flow of compost material down the inclined trough, thereby to blow plastics separated from the compost material over the longitudinal dam.

12. The method of claim 11, wherein the inclined trough is inclined between about 10° from horizontal to about 30° from horizontal.

13. The method of claim 12, further comprising configuring the plurality of riffles to be adapted to a median particle size of the compost material.

14. The method of claim 12, further comprising inducing a reciprocating vibratory motion substantially parallel to the direction of flow of compost material down the inclined trough.

15. The method of claim 14, wherein the reciprocating vibratory motion has a frequency in the range from about 600 cycles per minute to about 1200 cycles per minute.

16. The method of claim 15, wherein the reciprocating vibratory motion has an amplitude range of about $1/16^{th}$ inch to about ¼ inch.

17. The method of claim 16, further comprising generating an air flow speed in a range from about 300 feet per minute to about 600 feet per minute.

18. The method of claim 17, further comprising generating the air flow utilizing one or more blowers or vacuums.

19. The method of claim 18, further comprising providing a coarse plastics discharge to discharge larger pieces of plastic separated from the compost material and blown over the longitudinal dam.

20. The method of claim 18, further comprising providing a fine plastics discharge to discharge finer pieces of plastic blown over the longitudinal dam utilizing a vacuum.

* * * * *